US005810091A

United States Patent [19]

Sundholm

[11] Patent Number: 5,810,091

[45] Date of Patent: Sep. 22, 1998

[54] METHOD FOR FIGHTING FIRE BY PRESSING OUT FIRE-EXTINGUISHING LIQUID WITH A GAS

[76] Inventor: Göran Sundholm, Ilmari Kiannon kuja 3, Fin-04310 Tuusula, Finland

[21] Appl. No.: 637,803

[22] PCT Filed: Nov. 14, 1994

[86] PCT No.: PCT/FI94/00511

§ 371 Date: May 8, 1996

§ 102(e) Date: May 8, 1996

[87] PCT Pub. No.: WO95/13114

PCT Pub. Date: May 18, 1995

[30] Foreign Application Priority Data

Nov. 12, 1993 [FI] Finland ..... 935033

[51] Int. Cl.[6] ..... A62C 35/02

[52] U.S. Cl. ..... 169/46; 169/9; 137/209; 417/103

[58] Field of Search ..... 169/9, 43, 46, 169/47, 71; 141/2, 18, 25, 27, 67; 137/208, 209; 417/103, 122, 225, 389, 393

[56] References Cited

U.S. PATENT DOCUMENTS 4,520,871 6/1985 Miller et al. ..... 169/9 X 5,253,682 10/1993 Haskett et al. ..... 141/67 X

*Primary Examiner*—Andrew C. Pike

*Attorney, Agent, or Firm*—Ladas & Parry

[57] ABSTRACT

A method for fighting fire uses a source of fire-extinguishing liquid, a source of gas at an available pressure, and interconnected hydraulic accumulators including at least one gas container and at least one liquid container. The hydraulic accumulators are charged by interconnecting the hydraulic accumulators into fluid communication with each other, initially filling the hydraulic accumulators with the gas at the available pressure from the source of the gas, and subsequently filling the liquid container with the fire-extinguishing liquid from the source of the fire-extinguishing liquid so that the fire-extinguishing liquid drives the gas from the liquid container into the gas container and compresses the gas in the gas container to a desired initial charging pressure and directs the fire-extinguishing liquid toward the fire upon occurrence of the fire. For the directing the gas presses the fire-extinguishing liquid out of the liquid container at the charging pressure toward the fire.

9 Claims, 1 Drawing Sheet

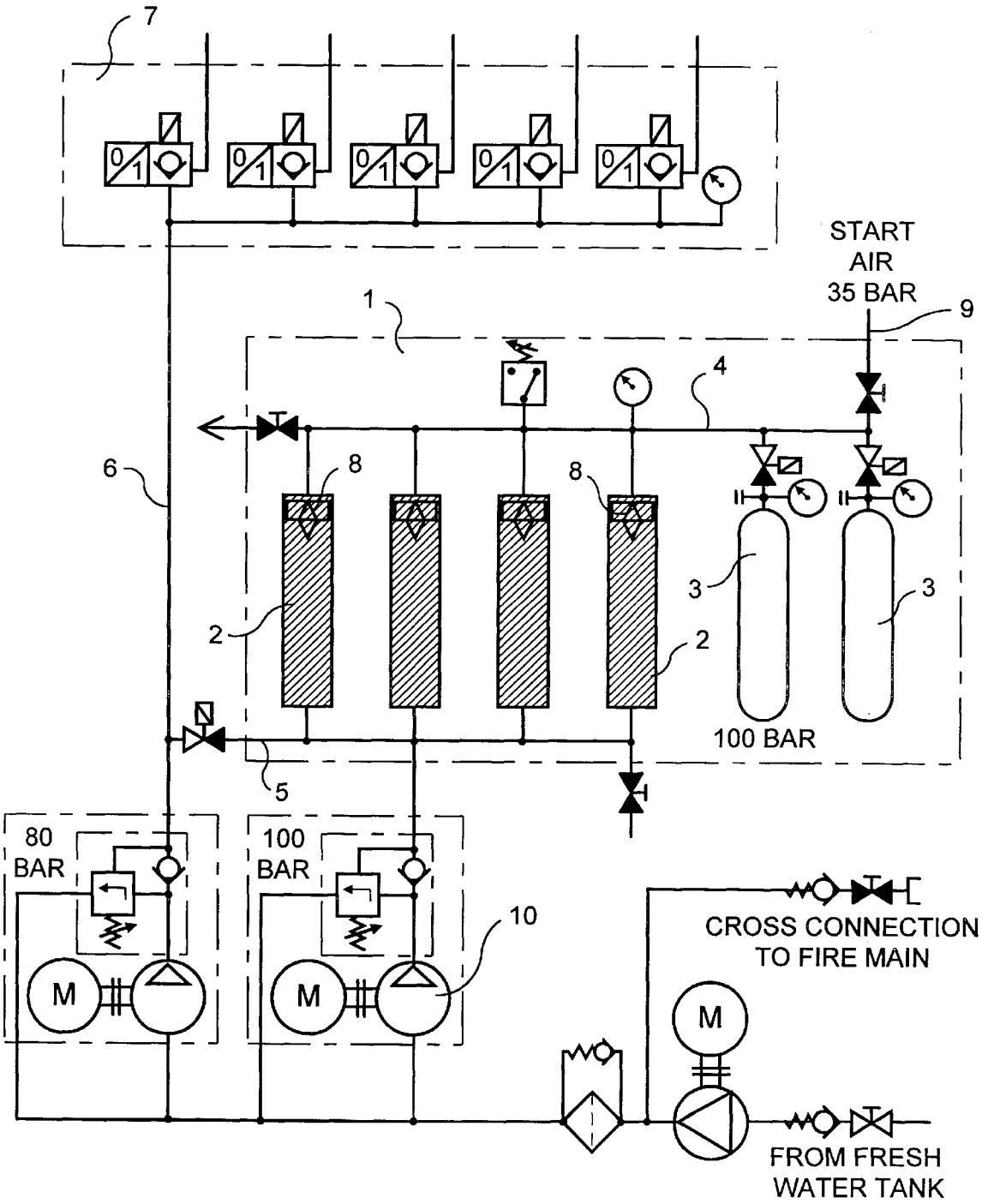
7
START
AIR
35 BAR
9
1
4
6
8
8
3
3
2
2
100 BAR
5
80
BAR
100
BAR
10
M
M
M
CROSS CONNECTION
TO FIRE MAIN
FROM FRESH
WATER TANK

METHOD FOR FIGHTING FIRE BY PRESSING OUT FIRE-EXTINGUISHING LIQUID WITH A GAS

The present invention relates to a method and an installation for fighting fire, in which a number of hydraulic accumulators are utilized for delivering extinguishing liquid to a number of spray heads or sprinklers.

The extinguishing liquid is usually driven out of the hydraulic accumulators by means of propellent gas, which is preferably nitrogen gas, though air can be used as well. The propellent gas shall generally be capable of having an initial charging pressure of about 100 bar.

Necessary pressure gas containers or bottles are mainly charged in advance somewhere else than where they are used. Accordingly, there is always a certain risk that the propellent gas is wasted, e.g., due to a leakage, before the fire-fighting installation is actually needed. On land, this does not generally imply any larger problem, while on ships and objects comparable with them, which lack necessary charging equipment, this risk is not considered acceptable.

The object of the invention is to eliminate this problem.

The procedure according to the invention is mainly such that, at a first stage, the hydraulic accumulators are filled with gas up to available pressure, and subsequently at a second stage, the accumulators are filled with liquid under a desired initial charging pressure, so that the liquid compresses the gas to the desired initial charging pressure.

There are preferably a number of liquid containers connected in parallel and a number of propellent gas containers likewise connected in parallel to the liquid containers, whereby the propellent gas of the gas containers is arranged to drive the liquid out of the liquid containers. At such an installation, the preferred procedure is that, at the first stage, all liquid containers as well as all propellent gas containers are filled with gas with available pressure, and subsequently, liquid is pumped into the liquid containers so that the liquid drives the gas out of the liquid containers and into the propellent gas containers, whereby the pressure in the propellent gas containers rises in proportion to the amount of gas from the liquid containers to the gas containers.

Accordingly, if the total volume of the liquid containers is for instance double as big as the volume of the gas containers, it is possible to achieve in this way a propellent gas pressure which is usable for fire-fighting and three times as high as the gas pressure available otherwise.

On ships, for instance, there is usually no available gas having a pressure higher than about 35 bar, i.e., so-called start air for diesel engines, etc. Thanks to the invention, this start air can charge the drive unit of a fire-fighting installation to a pressure of about 100 bar without difficulty.

When air is used as propellent gas in a hydraulic accumulator unit for fire-fighting, it is usually not desirable that the propellent air flows with the extinguishing liquid to the seat of fire. This can be avoided by providing the liquid containers with floating bodies closing an outlet aperture for the liquid after the containers have been emptied of liquid. For this purpose, the floating bodies may be provided, e.g., with conical elements, which penetrate into the liquid outlet aperture when the container is empty and plug it up. The floating bodies are preferably provided with corresponding elements also on the gas side for securing that liquid does not penetrate into the propellent gas containers while the liquid containers are filled.

The invention will be described in the following in greater detail with reference to a preferred embodiment shown in the attached drawing.

In the drawing, a drive unit of an installation for fighting fire is indicated by reference numeral 1. The drive unit comprises four liquid containers 2 and two propellent gas containers 3; the number of the containers 2 and 3 may vary as desired. In the drawing, the drive unit is ready for use with the containers 2 entirely filled with liquid and with the propellent gas containers 3 charged to a pressure of about 100 bar. At an activation, the gas containers 3 are connected, one at a time or simultaneously, to a common feeder line 4, whereby the gas presses the liquid out of the containers 2 via a common outlet line 5 and a feeder line 6 to a current fire zone 7.

Floating bodies arranged in the containers 2 are indicated by 8, a gas feeder line from a separate gas source, e.g., so-called start air for diesel engines, etc., on a ship, is indicated by 9, and a liquid pump of about 100 bar is indicated by 10.

When necessary, if the propellent gas in the containers 3 were wasted for some reason, the drive unit may be charged to a state ready for use in the following way by means of start air from the line 9, which start air can be supposed to have a pressure of about 35 bar. At a first stage, all containers 2 and 3 are filled with start air to a pressure of 35 bar, and subsequently, the line 9 is closed. At a second stage, the containers 2 are filled with liquid by means of the pump 10, the liquid driving the initially fed gas out of the containers 2 into the containers 3. If each container 2 and 3, respectively, has the same size, the containers 3 will be charged to a pressure of about 100 bar.

At an activation of the installation, the floating bodies 8 sink downwards in the containers 2 as soon as the liquid is driven out and reaches the bottom of the respective container when it has been entirely emptied. Since it is not usually desirable that the propellent air flows with the extinguishing liquid to the seat of fire, the floating bodies 8 are preferably arranged to close the outlet aperture in the bottom of the respective liquid container 2. For this purpose, the floating bodies may be provided, e.g., with conical elements penetrating into the liquid outlet aperture and closing it when the container is empty. The floating bodies are preferably provided with corresponding elements also on the gas side, for securing that liquid is not penetrating into the propellent gas containers while the liquid containers are filled. To construct closing elements like that does not cause any difficulty for one skilled in the art, and therefore, they are not shown in detail in the drawing.

The number of liquid containers 2 and gas containers 3, as well as their mutual volumes, may vary according to wishes. No separate gas containers are needed, but the liquid containers may be closed at the top, whereby it is naturally sufficient with a valve effect downwards by the floating bodies 8. Between the floating bodies 8 and the enclosing container wall, there is a distinct space, preferably somewhat bigger than the drawing gives impression of, due to which the containers 2 can have a simple "rough" construction without surface finish. Instead of so-called start air, any other available gas source can be used.

I claim:

1. A method for fighting fire using a source of fire-extinguishing liquid, a source of gas at an available pressure, and interconnected hydraulic accumulators including at least one gas container and at least one liquid container, said method comprising:

charging said hydraulic accumulators, said charging comprising interconnecting said hydraulic accumulators into fluid communication with each other, initially filling said hydraulic accumulators with said gas at said available pressure from said source of said gas, and subsequently filling said liquid container with said fire-extinguishing liquid from said source of said fire-extinguishing liquid so that said fire-extinguishing liquid drives said gas from said liquid container into said gas container and compresses said gas in said gas container to a desired initial charging pressure; and directing said fire-extinguishing liquid toward the fire upon occurrence of the fire, said directing comprising pressing said fire-extinguishing liquid out of said liquid container with said gas in said gas container at said charging pressure toward the fire.

2. The method according to claim 1, wherein:

the interconnected hydraulic accumulators comprise a number of other liquid containers (2) connected in parallel and a number of other gas containers (3) connected in parallel to all of the liquid containers; and the pressing comprises pressing the liquid out of all of the liquid containers.

3. The method according to claim 2, wherein the gas is so-called start air for diesel engines.

4. The method according to claim 3, and further comprising floating a body (8) in one of the liquid containers (2) for closing a liquid outlet aperture of the one liquid container and ending the directing of the fire-extinguishing liquid toward the fire from the one of the liquid containers when the gas has pressed the fire-extinguishing liquid out of the one of the liquid containers.

5. The method according to claim 4, wherein the floating of the body further comprises closing an outlet aperture for the gas when the fire-extinguishing liquid has pressed the gas from the one liquid container.

6. The method according to claim 2, and further comprising floating a body (8) in one of the liquid containers (2) for closing a liquid outlet aperture of the one liquid container and ending the directing of the fire-extinguishing liquid toward the fire from the one of the liquid containers when the gas has pressed the fire-extinguishing liquid out of the one of the liquid containers.

7. The method according to claim 6, wherein the floating of the body further comprises closing an outlet aperture for the gas when the fire-extinguishing liquid has pressed the gas from the one liquid container.

8. The method according to claim 1, and further comprising floating a body (8) in the at least one liquid container (2) for closing a liquid outlet aperture of the at least one liquid container and ending the directing of the fire-extinguishing liquid toward the fire when the gas has pressed the fire-extinguishing liquid out of the at least one liquid container.

9. The method according to claim 8, wherein the floating of the body further comprises closing an outlet aperture for the gas when the fire-extinguishing liquid drives the gas from the at least one liquid container.

* * * * *